US007620340B2

(12) United States Patent
Kinokuni

(10) Patent No.: US 7,620,340 B2
(45) Date of Patent: Nov. 17, 2009

(54) IMAGE FORMING APPARATUS WITH CLEANING BLADE LUBRICATION

(75) Inventor: Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 11/831,041

(22) Filed: Jul. 31, 2007

(65) Prior Publication Data

US 2009/0080917 A1 Mar. 26, 2009

Related U.S. Application Data

(62) Division of application No. 11/296,282, filed on Dec. 8, 2005, now Pat. No. 7,277,653.

(30) Foreign Application Priority Data

Dec. 10, 2004 (JP) ..... 2004-358441

(51) Int. Cl.
*G03G 15/00* (2006.01)

(52) U.S. Cl. ..... 399/71; 399/346

(58) Field of Classification Search ..... 399/71, 399/346

See application file for complete search history.

(56) References Cited

U.S. PATENT DOCUMENTS 4,711,555 A 12/1987 Toshimitsu et al. ..... 399/343

FOREIGN PATENT DOCUMENTS

JP 2000-231274 8/2000

*Primary Examiner*—David M Gray
*Assistant Examiner*—Bryan P Ready
(74) *Attorney, Agent, or Firm*—Fitzpatrick, Cella, Harper & Scinto

(57) ABSTRACT

An image forming apparatus includes an image bearing member which bears a toner image, a transfer member which transfers the toner image on the image bearing member to a transfer material, a cleaning blade which is brought into contact with and separated from the image bearing member and which removes transfer remaining toner remaining on the image bearing member where the toner image is transferred; and executing means which executes a toner cleaning mode such that the cleaning blade is brought into contact with and separated from the image bearing member so as not to remove a part of the transfer remaining toner remaining on the image bearing member, and then the cleaning blade having been separated from the image bearing member contacts the part of the transfer remaining toner remaining on the image bearing member when the cleaning blade again is brought into contact with the image bearing member.

4 Claims, 4 Drawing Sheets

(B) PRIOR ART

IMAGE FORMING APPARATUS WITH CLEANING BLADE LUBRICATION

This application is a divisional of U.S. patent application Ser. No. 11/296,282 filed Dec. 8, 2005.

BACKGROUND OF THE INVENTION

1. Field of the Invention

The present invention relates to an image forming apparatus in which a toner image formed on an image bearing member is transferred to a recording medium to form an image, particularly to the image forming apparatus in which toner remaining on the image bearing member is removed by a blade member after the transfer.

2. Description of the Related Art

The image forming apparatus in which the image bearing member is rotated plural times at the time of the image formation is mainly used due to the recent colorization of the image forming apparatus. In this kind of image forming apparatus, a cleaning member removing the toner on the image bearing member is brought into contact with or separated from the image bearing member. The blade member is used as the cleaning member because a configuration of the blade member is simple.

In order to prevent abrasion of the blade member in removing the toner, it is necessary that the toner adheres moderately onto an edge of the blade. During the removal of the toner, a part of the toner to be removed remains on the edge to prevent the abrasion of the blade member.

However, sometimes the toner is separated from the edge by vibration associated with the contact and separation action of the blade member, which causes the edge to come into contact with the image bearing member while the toner does not sufficiently exist between the edge and the image bearing member. Therefore, there is a problem that the abrasion of the blade member is generated when the blade member comes into contact with the image bearing member.

SUMMARY OF THE INVENTION

An object of the invention is to prevent the abrasion of the blade member when the blade member comes into contact with the image bearing member.

Another object of the invention is to provide an image forming apparatus including an image bearing member; a toner image forming means which forms a toner image on the image bearing member; a transfer member which transfers the toner image on the image bearing member to a transfer material; a blade member which is brought into contact with and separated from the image bearing member to remove transfer remaining toner, the transfer remaining toner not being transferred to the transfer material but remaining on the image bearing member; and abutting control means which forms abutting toner image on the image bearing member to cause the blade member in a separated state to abut onto the abutting toner image.

DESCRIPTION OF THE PREFERRED EMBODIMENT

According to the present invention, the above-described problem can be solved by providing abutting control means which forms an abutting toner image on an image bearing member and which makes the blade member in the separated state abut on the abutting toner image.

That is to say, the blade member is brought into contact with the image bearing member in a state that the toner exists sufficiently between the blade member and image bearing member, and therefore the present invention can prevent the abrasion of the blade member.

First Embodiment

Figure 1:
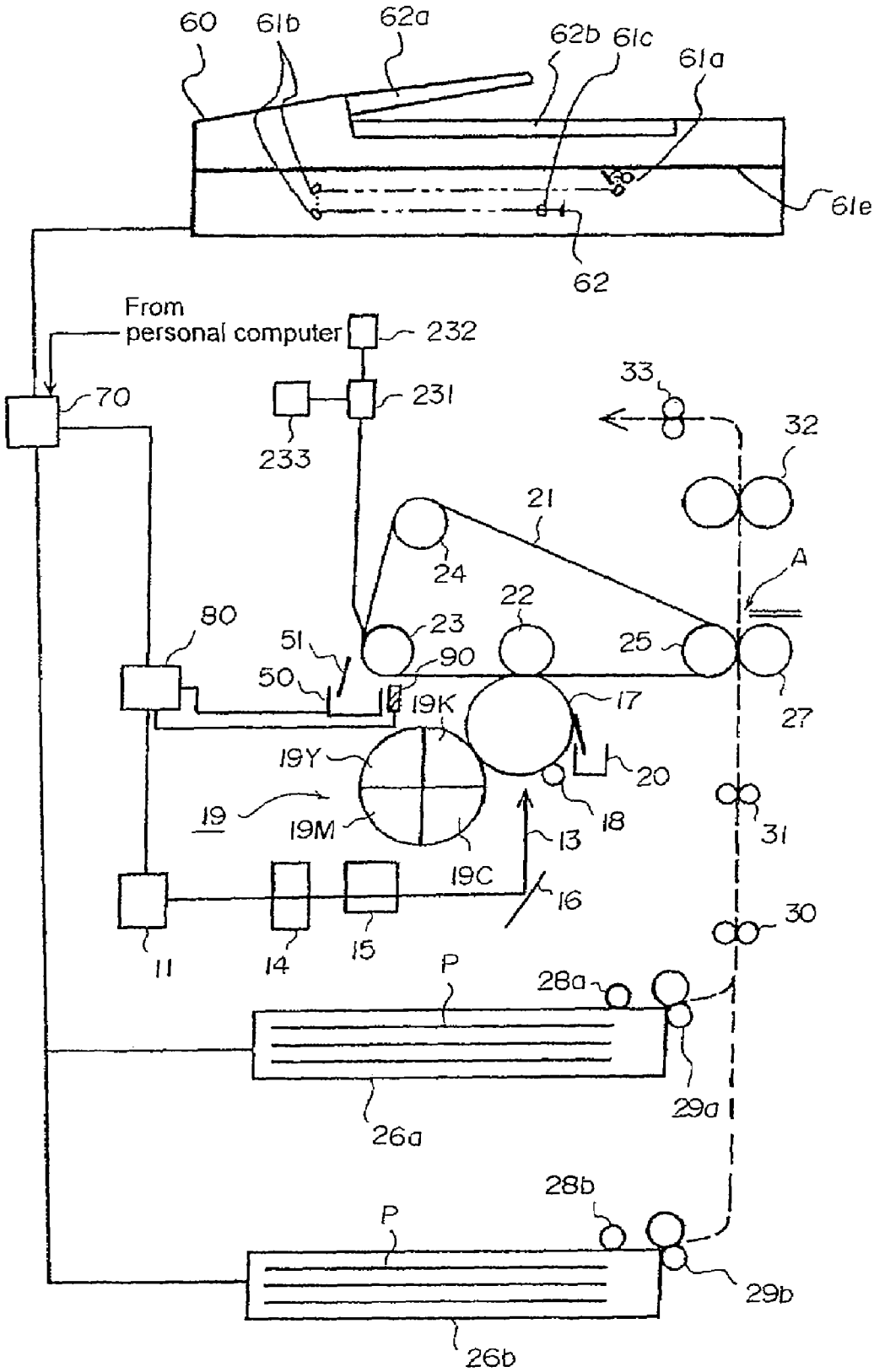
FIG. 1 is a schematic view showing an image forming apparatus according to a first embodiment.
Figure 2:
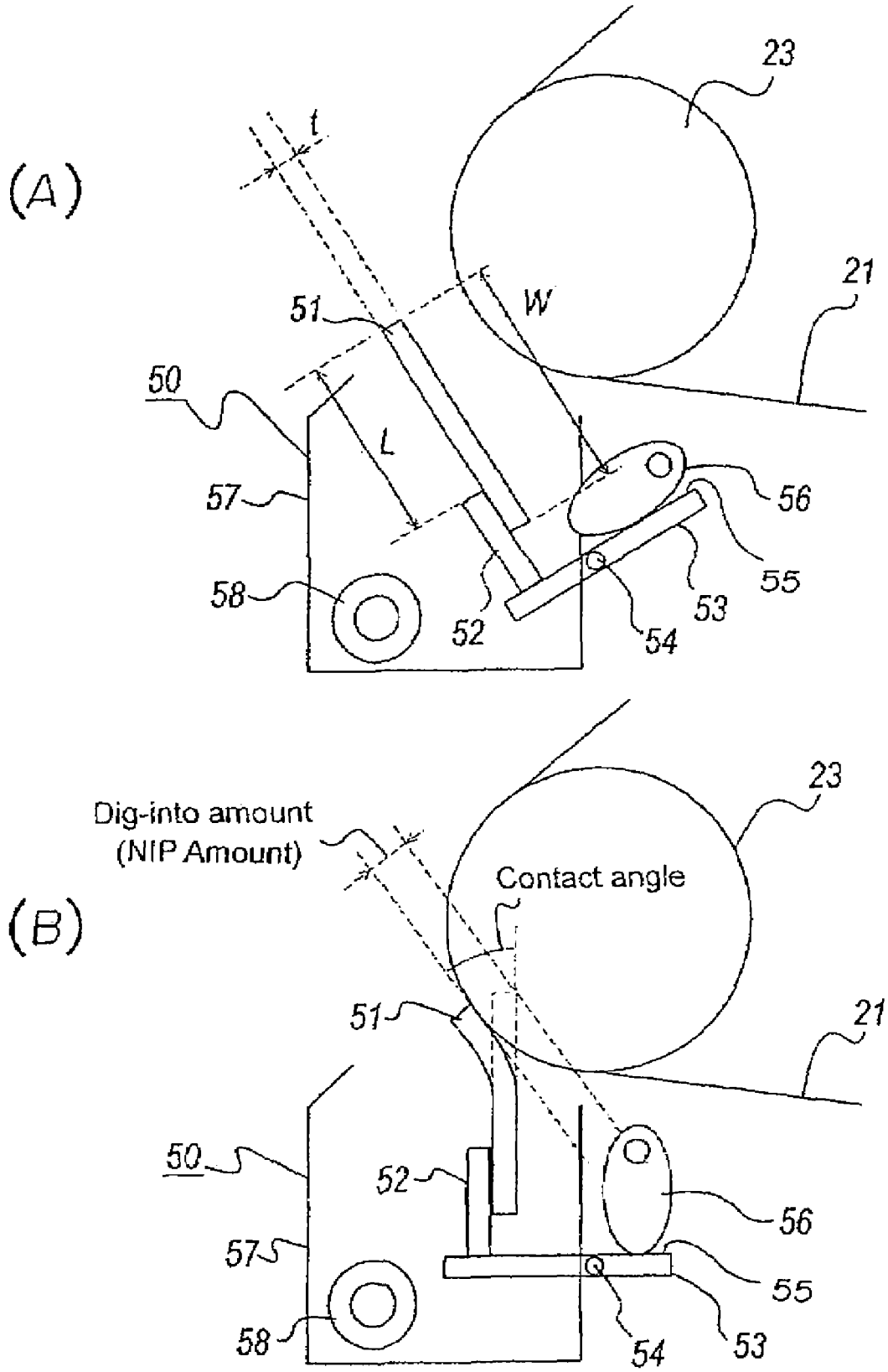
FIG. 2A is a view explaining a configuration of a cleaning device.
FIG. 2B is a view explaining a configuration of a cleaning device.
Figure 3:
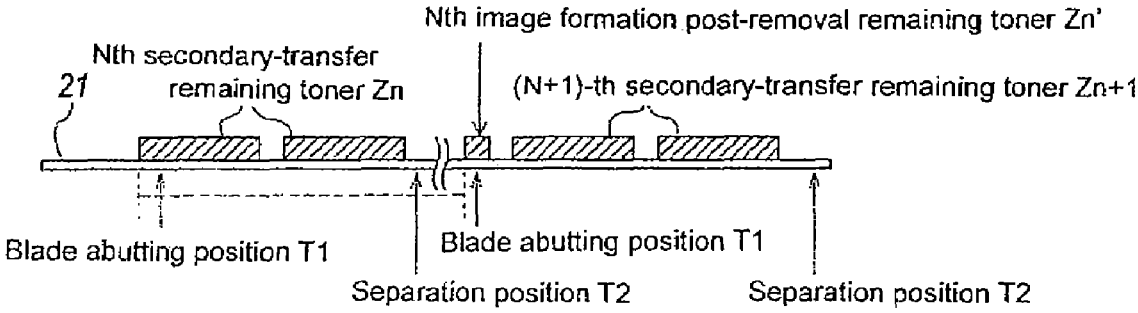
FIG. 3A is a view explaining a position where secondary-transfer remaining toner on an intermediate transfer belt and a blade are brought into contact with and separated from each other.
FIG. 3B is a view explaining a position where secondary-transfer remaining toner on an intermediate transfer belt and a blade are brought into contact with and separated from each other.
Figure 3:
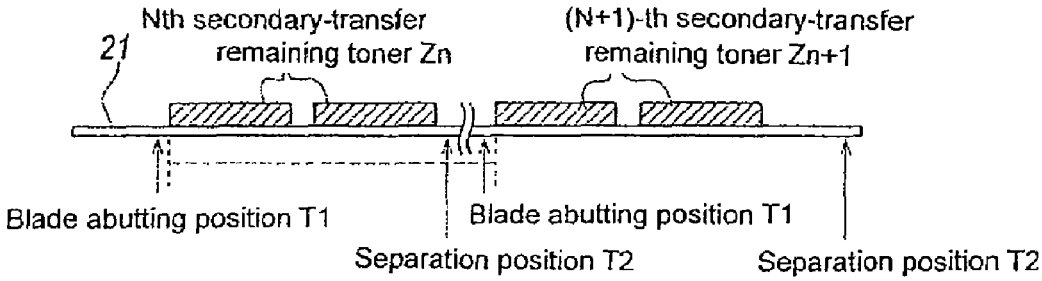

An image forming apparatus according to a first embodiment of the invention will be described below. FIG. 1 is a schematic view showing an image forming apparatus according to the first embodiment, FIGS. 2A and 2B are views explaining a configuration of a cleaning device, and FIGS. 3A and 3B are views explaining a position where the toner image on the intermediate transfer belt and the blade are brought into contact with and separated from each other.

The image forming apparatus shown in FIG. 1 is an intermediate transfer type of color image forming apparatus including one photosensitive drum and one intermediate transfer member (image bearing member). After a photosensitive drum 17 which is of the image bearing member is evenly charged by a charger 18, the photosensitive drum 17 is irradiated with a laser beam 13 from a light source 11 through a rotary polygon mirror 14, a lens 15, and a mirror 16 based on color information of each color, and a latent image of each color is exposed. CPU 70 form the color information of each color based on electronic data concerning image information transmitted from an original reading device 60 or a personal computer connected to the image forming apparatus.

An original placed on an original tray 62*a* of the original reading device 60 is transmitted to a platen 61*e*, and a whole surface of the original is scanned by a first mirror unit 61. The original in which the image read is completed is discharged to a discharge tray 62*b*. The image scanned by the first mirror unit 61*a* is guided to CCD 62 through a second mirror unit 61*b* and a lens 61*c* and the image is converted into the electronic data and transmitted to CPU 70. The original reading device 60 and the personal computer transmit information on a transfer material P used for simultaneously the image formation to CPU 70 along with the image information.

A rotary type development device 19 develops the latent image on the photosensitive drum 17 to form the toner image by yellow, magenta, cyan, and black development units (toner image forming means) 19Y, 19M, 19C, and 19K. The formed toner images are transferred to an intermediate transfer belt 21 which is of the intermediate transfer member by a primary transfer roller 22. A drum cleaner 20 removes primary-transfer remaining toner remaining on the photosensitive drum 17 rotated in a direction of an arrow R2, which provides the photosensitive drum 17 for the next image formation.

The intermediate transfer belt 21 is pulled by a drive roller 23, a tension roller 24, and a driven roller 25. When the drive roller 23 is rotated by a motor 231, the intermediate transfer belt 21 is rotated at a speed in synchronization with a circumferential speed of the photosensitive drum 17. The intermediate transfer belt 21 is formed by a film-like belt whose thickness is set at, e.g., 0.1 mm. In the film-like belt, a proper amount of conductive agent such as carbon black is dispersed in a synthetic resin such as polyimide, polycarbonate, polyester, and polypropylene or various kinds of rubber. A circumferential length of the intermediate transfer belt 21 is set at an integral multiple (for example, triple) of the circumferential length of the photosensitive drum 17.

The primary transfer of the toner images of the colors is performed in a superposing manner by the primary transfer roller 22 while the intermediate transfer belt 21 is rotated plural times, and a color toner image is borne by the intermediate transfer belt 21. When the color toner image is formed, a secondary transfer roller (transfer member) 27 which is separated from the driven roller 25 abuts on the intermediate transfer belt 21, and the secondary transfer roller 27 collectively performs secondary transfer to the transfer material P in a secondary transfer region A. The secondary transfer roller 27 is arranged while being able to be brought into contact with and separated from the intermediate transfer belt 21 as needed. When the color image is formed, the secondary transfer roller 27 is separated from the intermediate transfer belt 21 until the primary transfer of the unfixed toner image of the final color is performed onto the intermediate transfer belt 21.

The transfer materials P are housed in sheet cassettes 26*a* and 26*b* the transfer materials P is separated and fed one by one with a pickup roller 28 and a separation feed roller pair 29*a* and 29*b*, and the transfer materials P is transferred to a secondary transfer unit by a conveyance roller 30 and a registration roller pair 31. In the transfer material P to which the toner image is transferred, the toner image is melted and fixed to the transfer materials P by applying heat and pressure with a fixing roller pair 32. Then, the transfer materials P is discharged outside the apparatus by a discharge roller pair 33

In the first embodiment, a cleaning device 50 is provided as an example of the cleaning means for removing adhesives, such as remaining toner and paper dust, which adhere to the surface of the intermediate transfer belt 21. The cleaning device 50 is arranged on an upstream side of the photosensitive drum 17 in a rotating direction of the intermediate transfer belt 21.

FIGS. 2A and 2B are an enlarged view showing a configuration of a main portion of the cleaning device and a periphery thereof. The cleaning device 50 includes a cleaning blade (blade member) 51, an accommodation unit 57, and an auger 58. The cleaning blade 51 removes the adhesives on the surface of the intermediate transfer belt 21. The accommodation unit 57 accommodates the adhesives, such as the remaining toner and the paper dust, which are removed by the cleaning blade 51. The auger 58 conveys the remaining toner and the like in the accommodation unit 57 to the outside of the cleaning device 50.

The cleaning blade 51 is made of an elastic body, the cleaning blade 51 is pressed against the surface of the intermediate transfer belt 21 moved at a speed of 140 mm/sec, and the cleaning blade 51 removes the adhesives on the surface of the intermediate transfer belt 21. A plate member having the thickness of 2 mm made of polyurethane can be cited as an example of the cleaning blade 51. However, the thickness and the material of the cleaning blade 51 are not limited to the above plate member.

Usually the cleaning blade 51 of the cleaning device 50 stands ready at a position where the cleaning blade 51 is separated from the intermediate transfer belt 21 until the final toner image is transferred onto the intermediate transfer belt 21, and the cleaning blade 51 is configured so as not to disturb the toner image transferred onto the intermediate transfer belt 21. After the final toner image is transferred onto the intermediate transfer belt 21, the cleaning blade 51 is pressed against the surface of the intermediate transfer belt 21 to perform the cleaning.

As shown in FIG. 2A, the cleaning blade 51 is fixed to a sheet metal 52 by bonding or the like, and the sheet metal 52 is attached to a metal pressing plate 53 by welding, bolting, or the like. The pressing plate 53 is rotatable about a fulcrum 54, and an eccentric cam 56 abuts on the sheet metal 52 on the opposite side to the fulcrum 54. The pressing plate 53 is biased by a spring (not shown) or the like toward the direction in which the pressing plate 53 is pressed against the eccentric cam 56, i.e., toward a counterclockwise direction.

In the configuration of the cleaning device 50, the eccentric cam 56 is rotated by a predetermined amount at a predetermined speed by a drive motor and a drive gear (not shown), and the pressing plate 53 is moved in a clockwise direction of FIG. 2A by the eccentric cam 56. Therefore, the cleaning blade 51 attached to the pressing plate 53 through the sheet metal 52 is pressed against the surface of the intermediate transfer belt 21 as shown in FIG. 2B. Further, in the configuration of the cleaning device 50, the eccentric cam 56 is rotated by the predetermined amount at the predetermined speed by the drive motor and the drive gear (not shown), and a pressing portion 55 of the pressing plate 53 is moved counterclockwise by the eccentric cam 56. Therefore, the cleaning blade 51 attached to the pressing plate 53 through the sheet metal 52 is separated from the surface of the intermediate transfer belt 21 as shown in FIG. 2A. Thus, the cleaning blade 51 is attached while being able to be advanced to (brought into contact with) and retracted from (separated from) the transfer belt 21 by rotating the eccentric cam 56.

The accommodation unit 57 of the cleaning device 50 may be configured to be moved onto the side of the intermediate transfer belt 21 according to the action in which the cleaning blade 51 is pressed against the intermediate transfer belt 21.

As shown in FIG. 2A, a front end portion of the cleaning blade 51 is pressed against the upstream side in the direction in which the intermediate transfer belt 21 is moved, a rear end of the cleaning blade 51 is located on the downstream side in the direction in which the intermediate transfer belt 21 is moved, and the rear end side of the cleaning belt 51 is arranged while inclined relative to the surface of the intermediate transfer belt 21. The cleaning blade 51 is made of polyurethane or the like. Therefore, when the cleaning blade 51 is pressed against the surface of the intermediate transfer belt 21 by the predetermined amount, the cleaning blade 51 is bent downward while the front end portion of the cleaning blade 51 is pressed against the surface of the intermediate transfer belt 21.

In the first embodiment, the cleaning blade 51 is made of polyurethane as described above. As shown in FIG. 2A, in the cleaning blade 51, a thickness t is 2 mm, a width W is 15 mm, a free length L is 10 mm, and the length is substantially total width of the intermediate transfer belt 21. A setting angle (hereinafter referred to as "SA") of the cleaning blade 51 is 17°, and a digging amount of the cleaning blade 51 into the intermediate transfer belt 21 (hereinafter referred to as "nip amount") is set at 1.1 mm. However, SA and the nip amount of the cleaning blade 51 may be set at other appropriate values.

Then, the action of the cleaning device 50 which is of the feature of the first embodiment will be described. FIGS. 3A and 3B are views explaining the position where the toner image on the intermediate transfer belt and the cleaning blade are brought into contact with and separated from each other. As shown in FIGS. 3A and 3B, in the first embodiment, the intermediate transfer belt 21 shall form two images while the intermediate transfer belt 21 goes around.

First the conventional control will be described with reference to FIG. 3B. Before a front end of an Nth secondary-transfer remaining toner Zn passes through, a blade abutting position T1 is set to cause the cleaning blade 51 to abut on the intermediate transfer belt 21. After the Nth secondary-transfer remaining toner Zn passes through, a separation position T2 is set to separate the cleaning blade 51 from the intermediate transfer belt 21. Two (N+1)-th images are formed while the intermediate transfer belt 21 is rotated plural times, and the blade abutting position T1 is set before the front end of an (N+1)-th secondary-transfer remaining toner Zn+1 passes through.

In the first embodiment, a part of the secondary-transfer remaining toner is not removed but caused to remain on the surface of the intermediate transfer belt 21. The cleaning blade 51 is controlled so as to abut on the transfer remaining toner when the cleaning blade 51 is caused to abut next time. The above control is performed by abutting control means 80. The control is not always performed in each time at which the cleaning is performed by the cleaning device 50, but the control is performed in each predetermined times (N times) of the image formation as needed. In the first embodiment, when the images having 5% image-ratios (ratio of an area of an image formed region to the whole surface of an image formable region) are continuously printed, a part of the secondary-transfer remaining toner remains in each 100 sheets, and the cleaning blade 51 in the separated state is caused to abut on the remaining secondary-transfer remaining toner. When the images having 3% image-ratios are continuously printed, a part of the secondary-transfer remaining toner remains in each 200 sheets, and the cleaning blade 51 in the separated state is caused to abut on the remaining secondary-transfer remaining toner.

For example, as shown in FIG. 3A, the blade abutting position T1 is set after the front end of the Nth secondary-transfer remaining toner Zn passes through. A method of causing the cleaning blade 51 in the separated state to abut on the remaining secondary-transfer remaining toner while a part of the secondary-transfer remaining toner remains on the surface of the intermediate transfer belt 21 without removing the secondary-transfer remaining toner during the continuous print. The separation position T2 is set after the secondary-transfer remaining toner Zn passes through. Therefore, the front end portion of the secondary-transfer remaining toner Zn remains on the intermediate transfer belt 21 (hereinafter referred to as post-removal remaining toner Zn'). At this point, from abutting start timing of the cleaning blade 51 and a drive time of the motor 231 measured by a timer 232, it is determined that the secondary-transfer remaining toner remains at which position on the intermediate transfer belt 21. Then the determined position is stored in the main body.

In the toner image on the (N+1)-th photosensitive drum 17, the image formation is started so as not to superpose the post-removal remaining toner Zn' which remains in the previous cleaning, and the primary transfer is performed on the intermediate transfer belt 21. Immediately after the post-removal remaining toner Zn' passes through the secondary transfer unit, the secondary transfer roller 27 abuts on the surface of the intermediate transfer belt 21, and the bias is applied to the secondary transfer roller 27 to perform the secondary transfer of the (N+1)-th toner image Zn+1 to the transfer material.

When the (N+1)-th secondary-transfer remaining toner Zn+1 is cleaned, the blade abutting position TI is set in the region of post-removal remaining toner Zn'. The separation position T2 is set after the secondary-transfer remaining toner Zn+1 passes through. For the secondary-transfer remaining toner of the final toner image during the continuous print, a part of the secondary-transfer remaining toner is not removed but always remains on the intermediate transfer belt 21 irrespective of the number of continuous prints. When only one print is formed, a part of the secondary-transfer remaining toner of the printed image is not removed but remains. When the image forming apparatus is in the stopped state in which the image is not formed, the cleaning blade 51 is separated from the intermediate transfer belt 21. When the image formation is started, before the latent image is formed on the photosensitive drum 17 based on the color information, the cleaning blade 51 abuts on the intermediate transfer belt 21 to clean the whole circumference of the intermediate transfer belt 21. At this point, the cleaning blade 51 abuts on the secondary-transfer remaining toner which is not removed but remains in performing the previous print job.

The small-particle-diameter toner functioning as a lubricant can securely be supplied between the cleaning blade 51 and the intermediate transfer belt 21 by performing the above control. From the result of experiments, it is confirmed that a torque of the intermediate transfer belt 21 is decreased. Therefore, it can be inferred that frictional force is decreased. Further, from the result of endurance tests, it is also confirmed that durability of the cleaning blade 51 is improved.

In the first embodiment, the post-removal remaining toner Zn' is formed by leaving the front end portion of the secondary-transfer remaining toner Zn. Alternatively, the control may be performed such that the rear end portion of the secondary-transfer remaining toner Zn is left.

Thus, according to the configuration of the first embodiment, the durability of the cleaning blade can be improved while excessive toner consumption is suppressed by utilizing the secondary-transfer remaining toner.

Second Embodiment

An image forming apparatus according to a second embodiment of the invention will be described below. In the second embodiment, the same component as the first embodiment is designated by the same numeral, and the description will not be shown.

The second embodiment is based on the control of the first embodiment. Further, in the second embodiment, control performing timing (frequency) is changed according to a kind of the transfer material.

When the continuous print is performed while a B5-size sheet and an A4-size sheet are mixed together, because the toner (secondary-transfer remaining toner Zn) supplied to the cleaning blade 51 is inevitably decreased, the frictional force is increased between the intermediate transfer belt 21 and the cleaning blade 51, and a torque increasing rate of the intermediate transfer belt 21 is increased. Therefore, the abutting control means 70 performs the control described in the first embodiment in periods shorter than usual (compared with the case in which only the A4-size transfer materials are used), i.e., the predetermined times N is decreased. In this case, a part of the secondary-transfer remaining toner of the toner image used for the A4-size transfer material is not removed but remains, and the cleaning blade 51 is caused to abut on the remaining secondary-transfer remaining toner. Accordingly, even if the print is performed while the small-size transfer material is mixed, the advantage of the invention can efficiently be obtained.

Third Embodiment

An image forming apparatus according to a third embodiment of the invention will be described below.

In the configuration in which the thermal fixing means is used, during the continuous image formation on OHT, a cardboard, and the like, it is necessary that the conveyance speed of the transfer material is decreased when the transfer material passes through the fixing means. Therefore, the control is performed such that the speed of the intermediate transfer belt 21 is temporarily decreased according to the fixing properties and then returned to the normal speed again. The speed of the intermediate transfer belt 21 is changed by changing the rotating speed of the motor 231 with a motor transmission (moving speed changing means) 233. When the sheet having the usual thickness (80 g/m$^2$) is used, the intermediate transfer belt 21 is moved at a constant speed of 140 mm/sec. On the other hand, when OHT or the cardboard (130 g/m$^2$) is used, the speed of the intermediate transfer belt 21 is 140 mm/sec while the primary transfer is performed, and the speed of the intermediate transfer belt 21 is changed to 70 mm/sec during the secondary transfer. That is, the removal of the secondary-transfer remaining toner is performed in the state in which the speed of the intermediate transfer belt 21 is 70 mm/sec. In the above control, the speed of the intermediate transfer belt 21 is changed while the cleaning blade 51 abuts on the surface of the intermediate transfer belt 21. Therefore, a load on the cleaning blade 51 is increased by the change in frictional force between the surface of the intermediate transfer belt 21 and the cleaning blade 51.

In the third embodiment, even if the continuous image formation is performed onto the transfer material such as OHT and the cardboard in which the fixing is slow, the control described in the first embodiment is performed in shorter periods, i.e., the predetermined times N is decreased. In the third embodiment, when the sheets having the usual thicknesses are continuously used, the control described in a fifth embodiment is performed in each 200 sheets of the transfer materials. On the other hand, when OHTs or the cardboards are continuously used, the control described in the fifth embodiment is performed in each 100 sheets of the transfer materials. That is, the frequency of the control is changed according to the speed of the intermediate transfer belt 21 in removing the secondary-transfer remaining toner on the intermediate transfer belt 21. Accordingly, the advantage of the invention can efficiently be obtained, even if the speed of the intermediate transfer belt 21 is changed when the transfer material such as OHT and the cardboard is used to remove the secondary-transfer remaining toner.

Fourth Embodiment

An image forming apparatus according to a fourth embodiment of the invention will be described below. In the fourth embodiment, the same component as the first embodiment is designated by the same numeral, and the description will not be shown.

The fourth embodiment is based on the control of the first embodiment. Further, in the fourth embodiment, the control performing timing (frequency) is changed according to environmental conditions.

When the cleaning blade 51 is used as the cleaning means, in a high-temperature and high-humidity environment, a deformation amount is increased by a change in hardness of the cleaning blade 52, which increases the load on the cleaning blade 51. Because the nip region formed between the surface of the intermediate transfer belt 21 and the cleaning blade 51 is increased as a moisture content (water mass included in air of 1 kg) is increased, the frictional force is increased. Because electric discharge products are generated on the surface of the intermediate transfer belt 21 due to the electric discharge of the primary transfer or the secondary transfer, filming or fusion is generated on the intermediate transfer belt 21, which further increases the friction coefficient on the surface of the intermediate transfer belt 21.

On the other hand, in a low-temperature and low-humidity environment, when the cleaning blade is used as the cleaning means, a peeling electric discharge phenomenon is generated in the primary transfer and the secondary transfer. In the usual image formation, it is obvious that the peeling electric discharge phenomenon hardly has an effect on the toner image. However, during the endurance, damage caused to the surface of the intermediate transfer belt 21 is largely accumulated in use, and the friction coefficient is largely changed on the surface of the intermediate transfer belt 21 by the use of 10000 sheets.

Thus, in the high-temperature and high-humidity environment or in the low-temperature and low-humidity environment, due to the change in properties of the cleaning blade and the change in surface of the intermediate transfer belt 21, the load on the cleaning blade is remarkably increased when compared with in an ordinary-temperature and ordinary-humidity environment.

In the fourth embodiment, the control described in the first embodiment is performed in shorter periods, i.e., the predetermined times N is decreased in the high-temperature and high-humidity environment or in the low-temperature and low-humidity environment.

An environmental sensor (detection means) 90 detects temperature and humidity near the cleaning blade 21 to compute the moisture content in air. Then, the abutting control means changes the control frequency according to the moisture content. In the fourth embodiment, when the moisture content in air is larger than 0 g and lower than 2.0 g (low-temperature and low-humidity environment), the control described in the fifth embodiment is performed in each time when the images are formed in the 100 A4-size sheets of the transfer materials. When the moisture content in air is at least 2.0 g and lower than 8.74 g (ordinary-temperature and ordinary-humidity environment), the control described in the first embodiment is performed in each time when the images are formed in the 200 A4-size sheets of the transfer materials. When the moisture content in air is at least 8.74 g and lower than 21.0 g (high-temperature and high-humidity environment), the control described in the fifth embodiment is performed in each time when the images are formed in the 100 A4-size sheets of the transfer materials. Accordingly, even in the environmental conditions, the advantage of the invention can efficiently be obtained, Fifth Embodiment A fifth embodiment of the invention will be described.

In the fifth embodiment, the toner image is formed on the intermediate transfer belt 21 by transferring the toner image, formed on the photosensitive drum 17, to the intermediate transfer belt 21. The cleaning blade 51 in the separated state is caused to abut on the toner image.

The fifth embodiment will be described with reference to FIG. 1. In the fifth embodiment, the same component as the first embodiment is designated by the same numeral, and the description will not be shown. The latent image, which is formed on the photosensitive drum 17 based on the color information of the first-color yellow, is developed to form the yellow toner image by the yellow development unit 19Y. The yellow toner image is transferred to the intermediate transfer belt 21 by the primary transfer roller 22. Then, the toner images of the second-color magenta and the third-color cyan are formed on the photosensitive drum 17 based on each piece of color information, and the toner images of the second-color magenta and the third-color cyan are transferred on the intermediate transfer belt 21 so as to superpose the yellow toner image. Before the final latent image of the fourth-color black is formed based on the color information, the latent image of the toner image (hereinafter referred to as "abutting toner image") on which the cleaning blade 51 abuts is formed on the photosensitive drum 17. In the longitudinal direction (axial direction of photosensitive drum), the size of the latent image of the abutting toner image is set at the maximum value of the width in which the toner image can be formed. In the moving direction, the latent image of the abutting toner image is set at about 10 mm. The latent image of the abutting toner image and the latent image based on the color information of the black are developed by the black development unit 19K. A distance between the abutting toner image and the toner images formed based on the pieces of color information is about 30 mm in the direction in which the intermediate transfer belt 21 is moved. The abutting toner image and the toner images formed based on the color information are moved to the secondary transfer region A. When the abutting toner image passes through the secondary transfer region A, the secondary transfer roller 27 abuts on the intermediate transfer belt 27, and the secondary transfer of the abutting toner image and the toner images is collectively performed to the transfer material P. On the other hand, the cleaning blade 51 is in the separated state when the secondary transfer of the toner images of yellow, magenta, cyan, and black is transferred, and then the cleaning blade 51 is controlled so as to abut on the abutting toner image.

Figure 4:
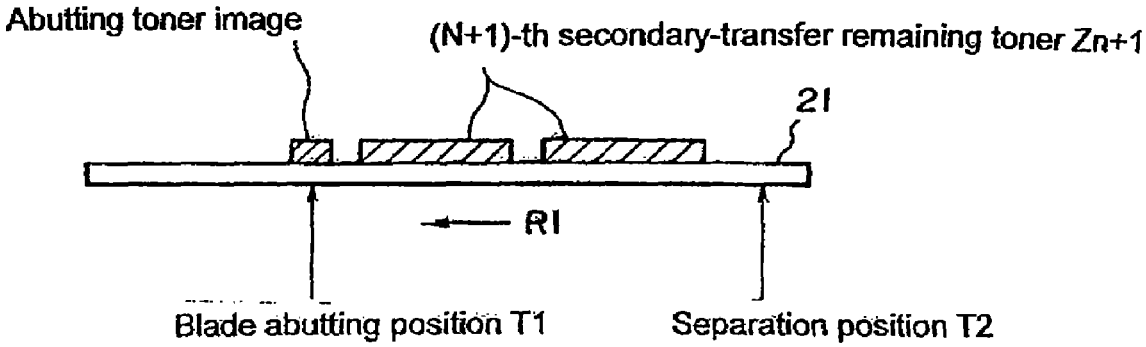
FIG. 4 is a view explaining a position where abutting toner image on the intermediate transfer belt and the blade are brought into contact with and separated from each other.

FIG. 4 shows the abutting toner image, the secondary-transfer remaining toner of the toner image formed based on the color information, and the abutting position T1 and the separation position T2 of the cleaning blade 51 on the intermediate transfer belt 21. Thus, the abrasion of the cleaning blade 51 can be prevented by causing the cleaning blade 51 to abut on the formed abutting toner image. The abutting toner image can also be formed in the first-color yellow, the second-color magenta, and the third-color cyan.

In the fifth embodiment, when the images having the 5% image-ratios are continuously printed, the abutting toner image is formed in each 100 sheets, and the cleaning blade 51 in the separated state is caused to abut on the abutting toner image. When the images having the 3% image-ratios are continuously printed, the abutting toner image is formed in each 200 sheets, and the cleaning blade 51 in the separated state is caused to abut on the abutting toner image.

Sixth Embodiment

A sixth embodiment of the invention will be described below.

The sixth embodiment is based on the control of the fifth embodiment. Further, in the sixth embodiment, the control performing timing (frequency) is changed according to the kind of the transfer material.

When the continuous print is performed to the small-size transfer materials such as the B5-size sheet, the toner (secondary-transfer remaining toner Zn) supplied to the cleaning blade 51 is inevitably decreased. Particularly the load is remarkably increased because the toner is not supplied to the end portion of the blade. Therefore, the control described in the fifth embodiment is performed in periods shorter than that of the usual case in which the A4-size transfer materials are used, i.e., the predetermined times N is decreased. In the sixth embodiment, when the image is formed in the B5-size sheet, the control described in the fifth embodiment is performed in each 50 sheets of the transfer materials.

Seventh Embodiment

In a seventh embodiment, the frequency at which the control of the fifth embodiment is performed is changed according to the speed of the intermediate transfer belt 21. In the seventh embodiment, as described in the third embodiment, the speed of the intermediate transfer belt 21 is also decreased according to the fixing properties when OHT or the cardboard is used. That is, when the sheet having the usual thickness is used, the intermediate transfer belt 21 is moved at a constant speed of 150 mm/sec. On the other hand, when OHT or the cardboard is used, the speed of the intermediate transfer belt 21 is changed to 75 mm/sec during the secondary transfer, and the secondary-transfer remaining toner is removed in the state in which the speed of the intermediate transfer belt 21 is set at 75 mm/sec.

In the seventh embodiment, when the sheets having the usual thicknesses are continuously used, the control described in the fifth embodiment is performed in each 200 sheets of the transfer materials. On the other hand, when OHTs or the cardboards are continuously used, the control described in the fifth embodiment is performed in each 100 sheets of the transfer materials.

Further, in the control described in the fifth embodiment, the control performing frequency can also be changed according to the environment of the image forming apparatus. The environmental sensor 90 detects the temperature and the humidity near the cleaning blade 21 to compute the water mass (moisture content) included in the 1 kg air. In the seventh embodiment, when the moisture content is 8.74 g (ordinary-temperature and ordinary-humidity environment), the control described in the fifth embodiment is performed in each time when the images are formed in the 200 A4-size sheets of the transfer materials. When the moisture content is 21.0 g (high-temperature and high-humidity environment), the control described in the fifth embodiment is performed in each time when the images are formed in the 100 A4-size sheets of the transfer materials.

CROSS-REFERENCE TO RELATED APPLICATION

This application claims the benefit of priority from the prior Japanese Patent Application No. 2004-358441 filed on Dec. 10, 2004 the entire contents of which are incorporated by reference herein.

What is claimed is:

1. An image forming apparatus comprising:

an image bearing member which bears a toner image;

a transfer member which transfers the toner image on the image bearing member to a transfer material;

a cleaning blade which is brought into contact with and separated from the image bearing member and which removes transfer remaining toner remaining on the image bearing member where the toner image is transferred; and executing means which executes a toner cleaning mode such that the cleaning blade is separated from the image bearing member so as not to remove a part of the transfer remaining toner of a first toner image on the image bearing member, and when cleaning a second toner image formed on a downstream side of the first toner image, the cleaning blade having been separated from the image bearing member is again brought into contact with the part of the transfer remaimng toner of the first toner image remaining on the image bearing member and removes the second toner image.

2. The image forming apparatus according to claim 1, wherein a frequency of an execution of the toner cleaning mode is changeable depending on a kind of the transfer material on which the transfer member transfers the toner image.

3. The image forming apparatus according to claim 1, further comprising:

moving speed changing means which changes a moving speed of the image bearing member, wherein a frequency of an execution of the toner cleaning mode is changeable depending on the moving speed of the image bearing member.

4. The image forming apparatus according to claim 1, further comprising:

detection means which detects an environmental condition in said image forming apparatus, wherein a frequency of an execution of the toner cleaning mode is changeable depending on a result of the detection means.

* * * * *